United States Patent [19]

Kobayashi

[11] Patent Number: 4,623,821

[45] Date of Patent: Nov. 18, 1986

[54] COLOR IMAGE DISPLAY DEVICE

[75] Inventor: Hiroo Kobayashi, Kusatsu, Japan

[73] Assignee: Mitsubishi Denki Kabushiki Kaisha, Tokyo, Japan

[21] Appl. No.: 668,965

[22] Filed: Nov. 7, 1984

[30] Foreign Application Priority Data

Dec. 7, 1983 [JP] Japan ..... 58-231984

[51] Int. Cl.[4] ..... H01J 31/00

[52] U.S. Cl. ..... 313/478; 358/64; 358/250; 313/116

[58] Field of Search ..... 313/2.1, 116, 416, 415, 313/474, 478, 495, 497; 315/13.1; 358/242, 250

[56] References Cited

U.S. PATENT DOCUMENTS

| | | | |
|---|---|---|---|
| 3,071,706 | 1/1963 | Waldorf | 358/242 |
| 3,152,277 | 10/1964 | Cutler et al. | 313/116 |
| 4,326,150 | 4/1982 | Kobayashi | 315/325 |
| 4,354,205 | 10/1982 | Lowe et al. | 358/250 |
| 4,368,485 | 1/1983 | Midland | 358/64 |

FOREIGN PATENT DOCUMENTS

| | | | |
|---|---|---|---|
| 3922214 | 8/1964 | Japan . | |
| 0191955 | 11/1982 | Japan | 313/497 |
| 0208057 | 12/1982 | Japan | 313/497 |
| 0212763 | 12/1982 | Japan | 313/497 |

OTHER PUBLICATIONS

"Light Emitting Tube for Giant Color Display"; Illum. Engng. Inst. Jpn., Hiroo Kobayashi and Kenzo Awazu, pp. 22–24.

*Primary Examiner*—David C. Nelms
*Assistant Examiner*—William L. Oen
*Attorney, Agent, or Firm*—Oblon, Fisher, Spivak, McClelland & Maier

[57] ABSTRACT

A color image display device comprises an optical sectioning plate interposed between adjacent light emitting parts of said cathode ray tubes, and a light diffusing plate opposite to the front face of the light emitting part of said each individual cathode ray tube.

5 Claims, 7 Drawing Figures

FIGURE 4 *PRIOR ART*
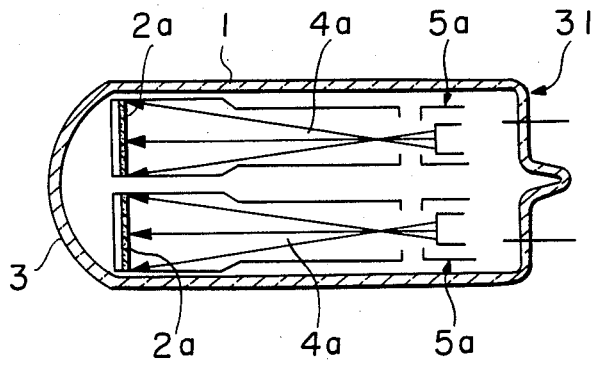
FIGURE 5 *PRIOR ART*
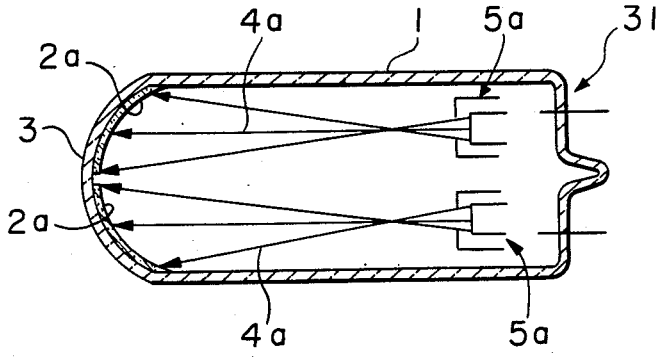

COLOR IMAGE DISPLAY DEVICE

BACKGROUND OF THE INVENTION

1. Field of the Invention

This invention relates to a giant-size color image display device of a construction, in which are arranged a multitude of cathode ray tubes to form a plurality of luminescent colors.

2. Description of Prior Art

Numerous problems have been encountered with those giant-sized display devices such as, for example, lighting display board at the baseball field, information display boards used on the roof-top or the wall surfaces of buildings, highways, and so on for transmitting commercial messages and pictures, traffic information, and so forth to general public, because such conventional display devices form picture images by arranging a multitude of electric bulbs which are selectively turned on and off.

Giving a few examples from among them: in the case of using electric bulbs, since light is obtained by incandescence of the bulb filament, the light emitted from it mainly assumes orange or whitish orange in color. On account of this, it is fairly difficult to cause a large amount of colored light in, for example, blue and green to be emitted from these electric bulbs. Further, in such display device using electric bulbs, brightness in each picture element has to be modulated by turn-on or turn-off of the electric current to be applied to the bulb filament, or making variable the electric current to be applied. These electric bulbs, however, are extremely low in their frequency response, which is as low as 10 Hz or below, on account of which the luminescent color per se to be emitted from these bulbs is subjected to change depending on the applied current, and also difficulty is accompanied in providing an intermediate tone display and a color display produced by combination of arbitrary colored lights. Furthermore, in such giant-sized display device, electric bulbs of 20 W to 40 W or so have to be arranged generally in a great number ranging from a few thousands to several tens of thousands or more with the consequence that there have been problems such as higher power consumption and considerable heat generation.

In view of such circumstances with the conventional display device, the present inventor proposed use of cathode ray tubes as the light source for such display device.

That is to say, according to this proposal, a desired picture image is displayed by, for example, arranging a large number of small-sized cathode ray tubes, each having a monochromatic fluorescent face such as red, green, blue, etc. According to this technique, not only energy conversion efficiency in converting electric energy to light energy can be remarkably improved in comparison with that of the electric bulb, but also various other advantages are resulted such that light sources in arbitrary luminescent colors can be obtained by selection of fluorescent material to be used, and so forth. When the cathode ray tube is used as the light source for such giant-sized display device, the display device can apparently be constructed with more advantages in its performance, operational reliability, maintenance cost, power consumption, and so on in comparison with those of the conventional bulb type display device.

FIG. 1 of the accompanying drawing illustrates one embodiment of the cathode ray tube to be employed as the light source for the giant-sized display device which the present inventor has so far put into practice as the prior art. In the drawing, a reference numeral 1 designates a vacuum envelope to maintain the interior of the cathode ray tube in the vacuum, which is in a cylindrical shape, for example. This vacuum envelope 1 has at its one end a face glass 3 with a fluorescent layer 2 having been coated on the inner surface thereof, and has, at its other end, an electron gun 5 for irradiating the overall surface of the fluorescent layer 2 with non-converging electron beam 4, terminals 6 for applying a required electric voltage to every part of the electron gun 5, and a stem part 7 to close the vacuum envelope 1. Numerals 8, 9 and 10, respectively, refer to a heater, a cathode, and a grid, all constituting the above-mentioned electron gun 5.

Explaining further the operations of this cathode ray tube, when a negative voltage is imparted to the cathode 9 through the grid 10 and predetermined electric current is caused to flow in the heater 8, thereby heating the cathode 9 and bringing the voltage in the grid 10 closer to an electric potential in the cathode 9, electron beam 4 is emitted from the cathode 9 to the fluorescent layer 2. The electron beam 4 is irradiated over the entire surface of the fluorescent layer 2 in the form of a non-converging beam having a predetermined expansion angle $\theta$ depending on various conditions such as a diameter of an aperture formed at the center of the grid 10, a space gap between the grid 10 and the cathode 9, an anode voltage, and so on, thereby causing the fluorescent layer 2 to emit light in a luminescent color in accordance with the fluorescent material used. As shown, for example, in FIG. 2, the cathode ray tubes are arranged in such a regular manner that the side thereof having the fluorescent layer 2 is faced frontward, and that each one of cathode ray tube 22 to emit red light and cathode ray tube 23 to emit blue light may come in between every two cathode ray tubes 21 to emit green light.

Explaining such arrangement of the cathode ray tubes in reference, for example, to FIG. 2, when a multitude of cathode ray tubes, each having a diameter of about 29 mm, are arranged, they are disposed at a pitch of 40 to 45 mm, taking into account a problem in constructing the display device in a water-tight structure in consideration of its outdoor use, and structure and convenience in wiring of the socket portion for supplying voltage to the cathode ray tube. In this case, however, the optimum viewing distance of the display device for easiness in viewing the displayed image and from the point of degree of color mixture is approximately 70 m or longer, which distance raises no particular problem as the display device for the benefit of spectators in the baseball field, for example. It has however been found out that, when considering use of such display device for indoor installation, outdoor advertisement, and so on, this viewing distance should be reduced to a half or shorter.

As method for reducing this viewing distance to a large extent, therefore, attempts have been made in obtaining a plurality of lights in the elementary colors with a single cathode ray tube, wherein the fluorescent layer in the light source cathode ray tube constituting each picture element is split into a plurality of sections and the fluorescent layers to emit different luminescent colors are combined.

FIG. 3 illustrates one example of such cathode ray tube 31. In this embodiment, the fluorescent layer 2 is split into three sector-shaped portions with the center of the tube being made the dividing point so that the elementary color lights of red (R), green (G), and blue (B), each being in substantially sector shape, may be emitted. Such cathode ray tube 31 is constructed, as shown, for example, in FIGS. 4 and 5, with the split fluorescent layers 2*a* in different color of their luminescent light and the electron guns 5*a* to generate non-converging electron beam 4*a* which cause these fluorescent layers to illuminate in predetermined colors, in combination. Accordingly, the fluorescent layer 2*a* of FIG. 4 is provided at the forward end of the electron gun 5*a*, while the fluorescent layer 2*a* of FIG. 5 is provided on the inner surface of the face glass 3.

When a multitude of such composite type light source cathode ray tubes are arranged to construct the image display device, the viewing distance thereof was found to be reduced to a half in comparison with the conventional display device constructed by arranging the single tube, monochromatic type light source cathode ray tubes.

SUMMARY OF THE INVENTION

It is therefore an object of the present invention to provide a color image display device constructed by arranging a multitude of cathode ray tubes, each having composite fluorescent layer as mentioned in the foregoing, in which a light diffusing plate to be used in combination with a partition wall which also serves as an optical sectioning plate for each individual cathode ray tube is provided at the front face of the light emitting part of the above-mentioned cathode ray tube, thereby remarkably improving the image quality at a near distance, in particular, and producing the color images which are easily viewed.

According to the present invention, there is provided a color image display device having a construction wherein cathode ray tubes, each having a plurality of fluorescent layers which emit light in mutually different elementary colors are arranged in a great number, characterized by providing an optical sectioning plate interposed between adjacent light emitting parts of said cathode ray tubes, and a light diffusing plate opposite to the front face of the light emitting part of said each cathode ray tube.

BRIEF DESCRIPTION OF THE DRAWING

The foregoing object, other objects as well as specific construction, function, and resulting effects of the display device according to the present invention will become more apparent and understandable from the following detailed description thereof, when read in conjunction with the accompanying drawing, wherein:

FIGS. 4 and 5 are side views, partly in longitudinal cross-section, of the cathode ray tube shown in FIG. 3;

DETAILED DESCRIPTION OF THE PREFERRED EMBODIMENT

In the following, the present invention will be explained in detail with reference to a preferred embodiment thereof shown in the accompanying drawing.

Figure 1:
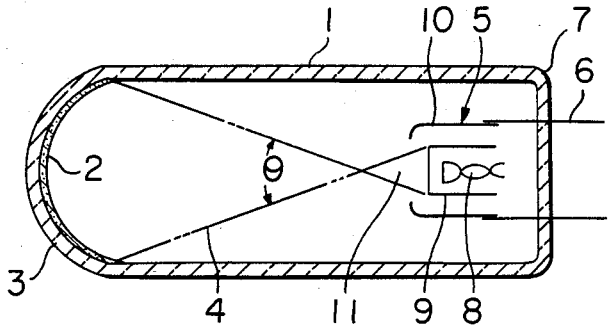
FIGURE 1 PRIOR ART
FIG. 1 is a side view, partly in longitudinal cross-section, of a conventional single tube, using a monochromatic type cathode ray tube for the light source.
Figure 2:
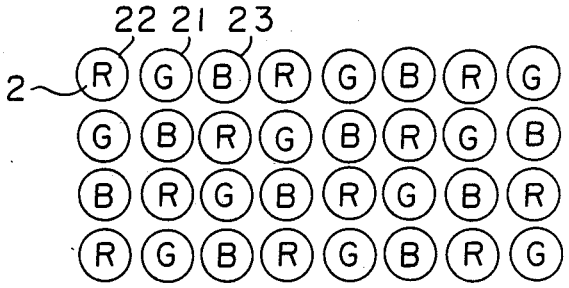
FIGURE 2 PRIOR ART
FIG. 2 is a diagram showing an arrangement of the cathode ray tube in FIG. 1.
Figure 3:
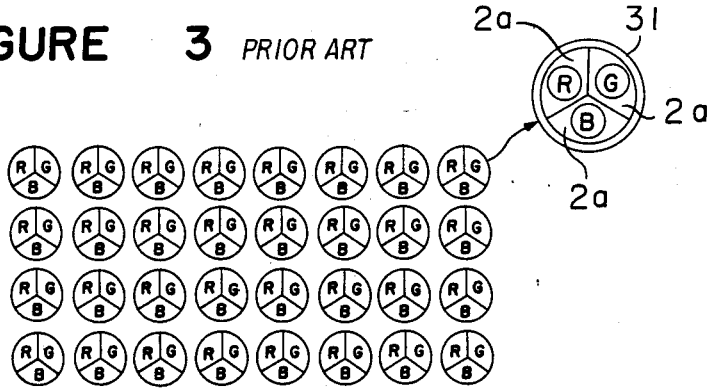
FIGURE 3 PRIOR ART
FIG. 3 is a diagram showing an arrangement of single tube, tricolor type cathode ray tube for light source.
Figure 6:
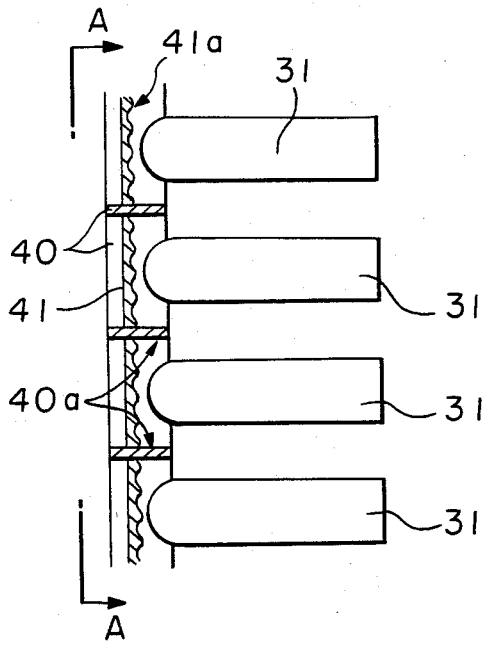
FIG. 6 is a side view, partly in longitudinal cross-section, of a color image display device according to one embodiment of the present invention.
Figure 7:
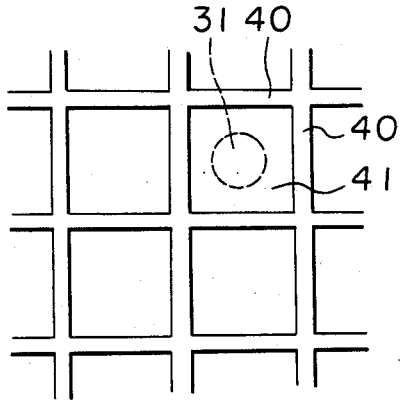
FIG. 7 is a front view of the display device shown in FIG. 6, taken along a line A—A therein.

FIGS. 6 and 7 are respectively a side view, partly in longitudinal cross-section, and a front view of the color image display device according to one embodiment of the present invention.

In FIGS. 6 and 7, a reference numeral 31 designates a cathode ray tube of a construction as has been explained in reference to FIGS. 4 and 5, i.e., a composite type cathode ray tube for light source. The light emitting part at the front face of each cathode ray tube 31 (fluorescent layer side) is split by a partition wall 40 which also serves as an optical sectioning plate for every cathode ray tube. The light emitting part at the front face of each cathode ray tube 31 is covered with a light diffusing plate 41 which is supported by this partition wall 40. The numeral 41*a* refers to a light diffusing surface.

While, as mentioned in the foregoing, the composite type cathode ray tube for light source has achieved considerable reduction in the viewing distance, the picture image to be seen in the near distance is not always of a satisfactory quality, because each and every elementary color point of red, green, and blue is seen separately as the viewer comes closer to the picture surface.

However, as proposed in the present invention, when the light diffusing plate 41 is disposed in front of the light emitting section of the cathode ray tube 31 so as to diffuse and combine each of colored light by means of this light diffusing plate 41, optical independence of each and every cathode ray tube 31 can be maintained by each of the partition walls 40, on account of which no impairment such as blurring of the picture image, etc. takes place, apparent area ratio of the light emitting part improves, and color separation in the picture image due to the combination of colors can be eliminated. Accordingly, the image quality in the near distance is particularly improved to a remarkable extent, and the color picture image which is easily viewable can be obtained.

Incidentally, by rendering the inside surface 40*a* of each partition wall 40 opposite to the light emitting part of the cathode ray tube 31 to be mirror-surfaced, the light proceeding toward the partition wall 40, out of those lights being emitted from the cathode ray tube 31, can be reflected by the mirror-surface to proceed toward the light diffusing plate 41, whereby range of effective use of light becomes widened and brightness of the display image is improved.

As has been explained in the foregoing, the color image display device according to the present invention contributes to remarkable improvement in the image quality, particularly, in the near distance and to production of easily viewable color image, which is attained by providing, at the front face of the light emitting part of the cathode ray tube, the light diffusing plate to be used in combination with the partition wall which also serves as the optical sectioning plate for each individual cathode ray tube.

Although, in the foregoing, the present invention has been described with reference to a preferred embodiment thereof, it should be noted that the embodiment is merely illustrative and not so restrictive, and that any changes and modifications may be made by those persons skilled in the art within the spirit and scope of the invention as recited in the appended claims.

What is claimed is:

1. A color image display device having an arrangement of a plurality of cathode ray tubes, each of said tubes having a plurality of fluorescent layers to emit light in different elementary colors, said device further comprising:

an optical sectioning plate interposed between adjacent light emitting parts of said cathode ray tubes wherein the inside surface of said optical sectioning plate is rendered a mirror-surface; and a light diffusing plate opposite to the front face of the light emitting part of each of said cathode ray tubes wherein said light diffusing plate is supported by said optical sectioning plate and wherein said light diffusing plate provides an improved image.

2. The color image display device according to claim 1, wherein each of said fluorescent layers in each of said cathode ray tubes is subjected to overall irradiation of independent non-converging electron beam.

3. The color image display device according to claim 1, wherein each of said cathode ray tubes has three fluorescent layers to emit the elementary color lights in red, green, and blue.

4. The color image display device according to claim 1, wherein said light diffusing plate is disposed in confrontation to the front face of the light emitting part of each of said cathode ray tubes with a space interval being provided therebetween.

5. The color image display device according to claim 1, wherein said optical sectioning plate projects from a light emitting surface of said light diffusing plate.

* * * * *